US009454860B2

(12) United States Patent
Lopez

(10) Patent No.: US 9,454,860 B2
(45) Date of Patent: Sep. 27, 2016

(54) INTEGRATED IMMOBILIZER FOB PAIRING

(71) Applicant: Secured Mobility, LLC, Georgetown, TX (US)

(72) Inventor: Emmanuel Enrique Lopez, Georgetown, TX (US)

(73) Assignee: Secured Mobility, LLC, Georgetown, TX (US)

( * ) Notice: Subject to any disclaimer, the term of this patent is extended or adjusted under 35 U.S.C. 154(b) by 195 days.

(21) Appl. No.: 14/212,132

(22) Filed: Mar. 14, 2014

(65) Prior Publication Data

US 2014/0266587 A1 Sep. 18, 2014

Related U.S. Application Data

(60) Provisional application No. 61/789,967, filed on Mar. 15, 2013.

(51) Int. Cl.
*G07C 9/00* (2006.01)

(52) U.S. Cl.
CPC ..... *G07C 9/00309* (2013.01); *G07C 9/00571* (2013.01); *G07C 2009/00333* (2013.01); *G07C 2009/00793* (2013.01)

(58) Field of Classification Search
CPC ..... G07C 9/00111; G07C 9/00309; G07C 9/00571; G07C 2009/00333; G07C 2009/00793
USPC ..... 340/5.61, 12.9
See application file for complete search history.

(56) References Cited

U.S. PATENT DOCUMENTS

| | | | | |
|---|---|---|---|---|
| 3,821,704 | A | 6/1974 | Sabsay | |
| 4,652,860 | A * | 3/1987 | Weishaupt | G07C 9/00182 180/287 |
| 4,926,665 | A | 5/1990 | Stapley et al. | |
| 5,046,093 | A | 9/1991 | Wachob | |
| 5,617,323 | A | 4/1997 | Stansberry et al. | |
| 5,650,774 | A | 7/1997 | Drori | |
| 5,661,804 | A | 8/1997 | Dykema et al. | |
| 5,740,428 | A | 4/1998 | Mortimore et al. | |
| 5,808,372 | A * | 9/1998 | Schwegler | B60R 25/04 307/10.4 |
| 5,864,297 | A | 1/1999 | Sollestre et al. | |
| 5,926,103 | A | 7/1999 | Petite | |
| 6,501,369 | B1 | 12/2002 | Treharne | |
| 6,801,967 | B2 | 10/2004 | Nakamura et al. | |
| 6,941,203 | B2 | 9/2005 | Chen | |
| 6,956,460 | B2 | 10/2005 | Tsui | |
| 6,998,956 | B2 | 2/2006 | Dix | |
| 7,124,058 | B2 | 10/2006 | Namaky et al. | |
| 7,315,238 | B2 | 1/2008 | Chambers et al. | |
| 7,375,673 | B2 | 5/2008 | Spilo | |

(Continued)

OTHER PUBLICATIONS

Operator s Instructions DJ-CM2000 Scanner/Transmitter Duplicator.

(Continued)

*Primary Examiner* — Benjamin C Lee
*Assistant Examiner* — Stephen Burgdorf
(74) *Attorney, Agent, or Firm* — Fish & Richardson P.C.

(57) ABSTRACT

An original generator generates a sequence of access values that are stored into a longer range communication device. A short range communication device, which can be the original generator, uses short range communication during a programming process to transmit an identification number to enable subsequence access from the longer range communication device using the sequence of access values.

19 Claims, 7 Drawing Sheets

(56) References Cited

U.S. PATENT DOCUMENTS

| | | | | |
|---|---|---|---|---|
| 7,463,959 | B2 | 12/2008 | Namaky | |
| 7,778,186 | B2 | 8/2010 | Oman et al. | |
| 7,900,966 | B1 | 3/2011 | Stennett | |
| 8,350,670 | B2 | 1/2013 | Kelly et al. | |
| 8,412,401 | B2 | 4/2013 | Bertosa et al. | |
| 8,466,774 | B2 | 6/2013 | Lopez et al. | |
| 8,584,841 | B1 | 11/2013 | Tiegs | |
| 8,854,181 | B2 | 10/2014 | Lopez et al. | |
| 8,912,883 | B2 | 12/2014 | Kobres | |
| 9,002,536 | B2 | 4/2015 | Hatton | |
| 9,171,456 | B2 | 10/2015 | Ramchandani et al. | |
| 9,286,743 | B2 | 3/2016 | Lopez | |
| 2003/0112121 | A1 | 6/2003 | Wilson | |
| 2003/0189530 | A1* | 10/2003 | Tsui | G08C 19/28 345/48 |
| 2004/0066308 | A1 | 4/2004 | Sampsell | |
| 2004/0088228 | A1* | 5/2004 | Mercer | G06Q 10/08 705/28 |
| 2004/0113786 | A1 | 6/2004 | Maloney | |
| 2004/0155793 | A1 | 8/2004 | Mui | |
| 2004/0252030 | A1 | 12/2004 | Trimble et al. | |
| 2005/0024229 | A1 | 2/2005 | Chuey | |
| 2005/0212655 | A1 | 9/2005 | Underdahl | |
| 2005/0225429 | A1 | 10/2005 | Burzio | |
| 2005/0231323 | A1 | 10/2005 | Underdahl et al. | |
| 2005/0248436 | A1 | 11/2005 | Hohmann et al. | |
| 2005/0269414 | A1* | 12/2005 | Kell | G07C 9/00896 235/492 |
| 2005/0285724 | A1 | 12/2005 | Schmidt et al. | |
| 2005/0288837 | A1 | 12/2005 | Wiegand et al. | |
| 2006/0176146 | A1 | 8/2006 | Krishan et al. | |
| 2006/0179057 | A1 | 8/2006 | Moretti | |
| 2006/0198523 | A1 | 9/2006 | Shearer | |
| 2006/0279467 | A1 | 12/2006 | LeMense et al. | |
| 2007/0001805 | A1 | 1/2007 | Utter et al. | |
| 2007/0008168 | A1 | 1/2007 | Liao et al. | |
| 2007/0096940 | A1 | 5/2007 | Laranang et al. | |
| 2007/0120641 | A1 | 5/2007 | Sommer et al. | |
| 2007/0176787 | A1 | 8/2007 | Iten et al. | |
| 2007/0200671 | A1 | 8/2007 | Kelley et al. | |
| 2007/0229301 | A1 | 10/2007 | Katz | |
| 2007/0296559 | A1 | 12/2007 | Fehr | |
| 2008/0150685 | A1 | 6/2008 | Desai et al. | |
| 2009/0113963 | A1 | 5/2009 | Pocrass | |
| 2009/0163140 | A1 | 6/2009 | Packham et al. | |
| 2009/0171684 | A1 | 7/2009 | Samolinski et al. | |
| 2009/0276115 | A1 | 11/2009 | Chen | |
| 2009/0278656 | A1 | 11/2009 | Lopez et al. | |
| 2009/0298020 | A1 | 12/2009 | Corcoran et al. | |
| 2010/0045423 | A1 | 2/2010 | Glickman et al. | |
| 2010/0069043 | A1 | 3/2010 | Khawand | |
| 2011/0190962 | A1 | 8/2011 | Peterson et al. | |
| 2011/0315569 | A1* | 12/2011 | Haag | G09F 21/04 206/38 |
| 2012/0008509 | A1 | 1/2012 | Myers et al. | |
| 2012/0242506 | A1 | 9/2012 | Nguyen et al. | |
| 2012/0249289 | A1* | 10/2012 | Freese | G08C 17/00 340/5.7 |
| 2012/0252365 | A1* | 10/2012 | Lam | G07C 9/00309 455/41.2 |
| 2012/0286927 | A1* | 11/2012 | Hagl | G07C 9/00309 340/5.61 |
| 2012/0317317 | A1 | 12/2012 | Kristiansson | |
| 2013/0069761 | A1 | 3/2013 | Tieman | |
| 2013/0226795 | A1 | 8/2013 | Hopper et al. | |
| 2013/0249677 | A1 | 9/2013 | Kohanek et al. | |
| 2013/0331976 | A1 | 12/2013 | Freeman et al. | |
| 2014/0152882 | A1 | 6/2014 | Samek et al. | |
| 2014/0229316 | A1 | 8/2014 | Brandon | |
| 2014/0266579 | A1 | 9/2014 | Lopez | |
| 2014/0266580 | A1 | 9/2014 | Lopez | |
| 2014/0266582 | A1 | 9/2014 | Lopez | |
| 2014/0266583 | A1 | 9/2014 | Lopez | |

OTHER PUBLICATIONS

Operator's Instructions, CT2000E/CT2000SR, Replacement Remote Control Operation.

Operator's Instructions, Model: RMC888; Duplicator Operating Instruction.

Operator's Instructions, "StingPro—Learning Remote—TX-44".

Operator's Instructions, "Skylink" Model 39, Universal Garage Door Remote Control.

Operator's Instructions, "JMA" CTM-200 Remote Control Duplicator Manual.

* cited by examiner

INTEGRATED IMMOBILIZER FOB PAIRING

CROSS-REFERENCE TO RELATED APPLICATIONS

This application claims priority to U.S. Application Ser. No. 61/789,967, filed on Mar. 15, 2013.

TECHNICAL FIELD

This invention relates to remote keyless vehicle access systems, and more particularly to access codes of the remote keyless vehicle access systems.

BACKGROUND

Wireless signal transmitter-receiver systems are employed in a variety of security systems and remote activation systems. Remote access devices are generally used in the automotive industry to activate and deactivate vehicle access systems. Remote access devices can also perform other tasks including remote starting, locking and unlocking doors, unlatching trunk decks or tail gates, opening windows or doors and operating convertible top mechanisms.

Such remote access devices may use a code generator and microcontroller. The code generator sometimes employs an algorithm that uses a property of the microcontroller to generate output codes.

SUMMARY

This specification describes technologies relating to programming a remote access device with a vehicle access system.

In general, innovative aspect of the subject matter described in this specification can be embodied in methods performed by a service provider that include the actions of actuating one or more functions of an original code generator, such as a rolling code generator, to generate a series of access values. Each actuation changes, such as by incrimination or by an algorithm, an access index value that references an access value of the series output by the original code generator. After the last actuation, the access index value references a final access value. The series of access values is a subset of a larger series of valid access values.

The service provider disables one or more functionalities of the original code generator to prevent the access index from changing. The service provider also labels the original code generator to identify which series of access values was generated from the original code generator. The service provider sets the access index to reference a preceding access value.

The service provider hosts a communication system configured to download the series of access values onto a longer range communication device, the longer range communication device having a longer range antenna.

The service provider then provides one or more replacement remote access devices to each end user of a plurality of end users. The remote access devices are longer range communication devices. The service provider also provides the original code generator to subsequent end users of the plurality of end users.

After an end user receives both a remote access device and the original code generator, the service provider then instructs the end user to use the hosted communication system to download the series of access values to the remote access device. The service provider instructs the end user on how to program an access system of a vehicle to subsequently allow the remote access device to control one or more functions of the vehicle. A part of the procedure for programming the vehicle includes initiating a programming mode of the vehicle, presenting the original generator to an immobilizer of the vehicle's access system, and communicating the identification value and the access index from the short range communication device to the access system. When the vehicle is successfully programmed, the end user retains the longer range communication device for later use but sends away or stores away the original generator.

Sometimes, the service provider may use a substitute short range communication device instead of the original generator by storing an identification value of a microcontroller of the original code generator onto a short range communication device. The service provider also sets an access index into the short range communication device. The value of the access index precedes the final value. The short range communication device has a short range antenna.

Another aspect of the invention features a method for producing a short range communication device for programming an access system for use with a longer range communication device. The method features generating a series of access values from the short range communication device and storing the series of access values in a communication network. The generated series of access value is a subset of an entire set of valid access values for an access system.

The method also features labeling the short range communication device with a unique label to identify the series of access values that the original communication device generated. The short range communication is sent to a plurality of users. The users pair different longer range communication devices with vehicle access systems by using the short range communication device to communicate the identification value through the short range antenna of the short range communication device.

In some examples, the identification value of a microcontroller of the short range communication device is copied into a second short range communication device that is used in place of the short range communication device. The short range communication device uses a short range antenna to communicate the identification value to an access system in order to pair a separate, longer range communication device. The communication may occur through an immobilizer device of the access system.

Some examples feature storing an access index into the short range communication device and configuring the short range communication device to communicate, through the short range antenna, the access index to the access system in order to pair the longer range communication device. The access index references a first access value of the series of access values, the first access value preceding other generated access values.

Some examples feature communicating, using a short range antenna of the short range communication device, the identification value and access index to a plurality of access systems. The short range communication device is sent to different users to be used with the different access systems, and is sent to each user one after another. The users return the remote access device after programming.

Communicating to an access system of a first vehicle enables a first remote access device to subsequently remotely control functions of the first vehicle when the first remote access device transmits, via a first longer range antenna, a first value from the series of access values to the first access system. Communicating to an access system of a second vehicle enables a second remote access device to operate with the second access system when the second remote access device transmits, via a second longer range antenna, the first value from the series of access values to the second access system.

The short range communication device may be an original generator that had one or more functionalities disabled, such as by opening a circuit, shorting a circuit, covering, a button, or by programming. These may be done to prevent the index from changing.

Another aspect of the invention features a system for pairing remote access devices with access systems. The system features a plurality of remote access devices. Each remote access device has a memory configured to store a sequence of access values and an access index for the sequence of access values and a longer range antenna configured to wirelessly transmit the access values. The system also features and a short range communication device. The short range communication device has a microcontroller unit identified by a certain identification value, memory configured to store an access index, a unique label, and a shorter range antenna. The short range communication device uses the shorter range antenna to communicate with an immobilizer of an access system to enable subsequent access to the access system from a certain remote access device via a longer range antenna of a certain access device.

In some examples, the remote access device stores a certain sequence of access values that are a subset of access values generated by an original access device having the certain identification value.

In some examples, a plurality of short range communication devices each have a microcontroller unit associated with an identification value different from some, but not necessarily all, other microcontrollers. They also have a memory configured to store an access index and a shorter range antenna.

In some examples a control unit physically couples to an on-board port of an access system. The remote access device can be one of a phone, a tablet, or a laptop. Each remote access device downloads, from a communication system, an application to communicate with the control unit to operate the vehicle access system.

In some examples, a distribution network is configured to receive a selected identification value or label and, as a response to receiving, store a selected sequence of access values into the memory of a selected remote access device. The distribution network is configured to store an access number referencing the selected sequence of access values as the access index of the selected remote access device.

In some examples, the short range communication device features a protective design preventing the access index from changing.

Another aspect of the invention features a short range communication device. The short range communication device has a short range antenna configured for wireless communication and also has a microcontroller unit identified by a device identification value. The communication device is configured to communicate, using the short range antenna, the device identification value with an immobilizer of a vehicle to enable access to the vehicle from a separate remote access device via a longer range antenna.

In some examples, the separate remote access device is configured to utilize a plurality of access values associated with the identification code, the access values being a subset of a larger set of valid access values for an access system of the vehicle.

In some examples, the short range antenna is a near field antenna. It can communicate using one or more frequencies approximately ranging from 1 kilohertz to 100 megahertz, each of the one or more frequencies being lower than any frequency used by the longer range antenna.

In some examples, the longer range antenna communicates using frequencies approximately ranging from 300 megahertz to 500 megahertz. The longer range antenna operates farther than 3 meters.

Some examples of the short range communication device store an index counter into a memory. The index counter is configured to be reset before the short range communication device communicates with an immobilizer.

Particular embodiments of the subject matter described in this specification can be implemented so as to realize one or more of the following advantages: a 3$^{rd}$ party service provider can provide replacement remote access devices that vehicle owners can program with their cars, even though the service provider may not know or be able to replicate each part, such as a code generator, of an original remote access device. The service provider can provide a replacement remote access device that separate from a mechanical key. The replacement remote access device can have a different design from the original access device. The service provider may be able to manufacture the replacement access device at a lower cost than the original remote access device. The replacement remote access device can have more functions that not available in the original remote access device. The replacement remote access device may work with multiple types of vehicle, so retailers can stock a smaller inventory and still service many different types of vehicles.

The details of one or more examples of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
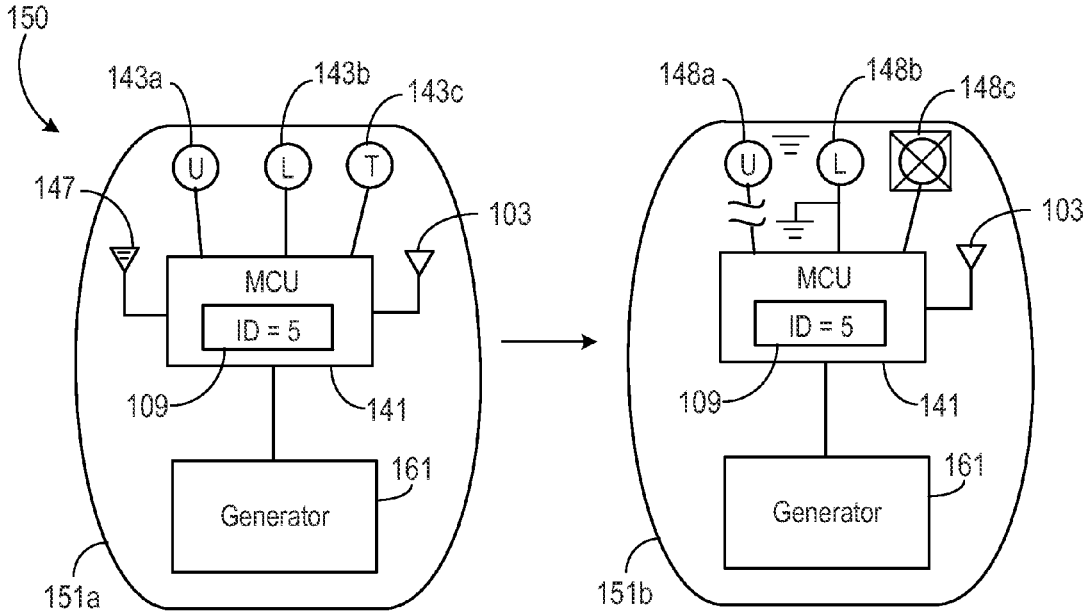
FIG. 1A is block diagram illustrating an original code generator and the original code generator as modified into a short range communication device.

FIG. 1A is a block diagram illustrating an original code generator 151*a* and the original code generator 151*b* as modified into a short range communication device. A service provider can modify the original code generator, e.g., for use in a process for programming replacement remote access devices. 3rd party service providers might want to build universal replacement remote access devices, but they might not know the specific algorithm used by a code generator. They might not know or be able to set the necessary microcontroller properties. In addition, a replacement remote access device may lack the ability to program certain vehicle types. A vehicle's owner must program a vehicle's access system before the owner can operate the vehicle using the remote access device. To compensate for these deficiencies, the service providers may provide the modified original code generator to the vehicle's owner.

The original generator device has a microcontroller 141 identified by an identification value 109. It has rolling code generator 161, buttons 143[*a-c*], long range antenna 147, and short range antenna 103.

A service provider can actuate the buttons to generate a series of access values, changing an index value each time. After generating and recording enough access values, the service provider can reset the index and protect it from changing again, e.g., by disabling certain functionalities. Examples of disabling include grounding circuitry such as button 148*b*, opening up wires such up such as for button 148*a*, covering buttons in a casing or removing them such as for button 148*c*, or coding the MCU to ignore inputs or otherwise prevent the access value from changing. The modified generator device will communicate information through short range antenna 003 and does not necessarily need the long range antenna or rolling code generator 161 anymore. The service provider then uses the modified generator as a short range communication device.

Figure 1B:
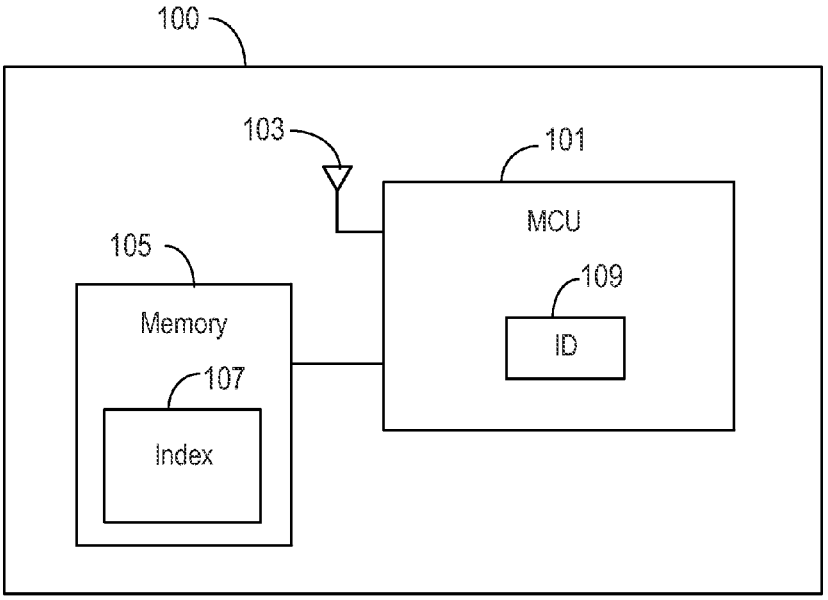
FIG. 1B shows an example short range communication device.

FIG. 1B shows an example short range communication device 100 after the modifications. The short range communication device has a controller 101 depicted as a microcontroller unit (MCU). The MCU has an associated identification number 109. A memory 105 and a short range antenna 103 are coupled to the MCU. The memory stores an index counter 107.

The short range antenna can be a near field antenna. It generally operates with a maximum range of several millimeters. Some short range antennas operate over several centimeters, and very few operate at a further distance. When programming the vehicle access system, an end user will transmit information, such as the ID and index counter, via the short range antenna to a vehicle access system for pairing a longer range communication device with the access system.

Some short range access devices have a protective design to prevent the index from changing. A service provider can employ the protective design after resetting the index but before sending the short range communication device to an end user. In the example illustrated in FIG. 1, the short range communication device has no input buttons for changing the index.

Figure 2A:
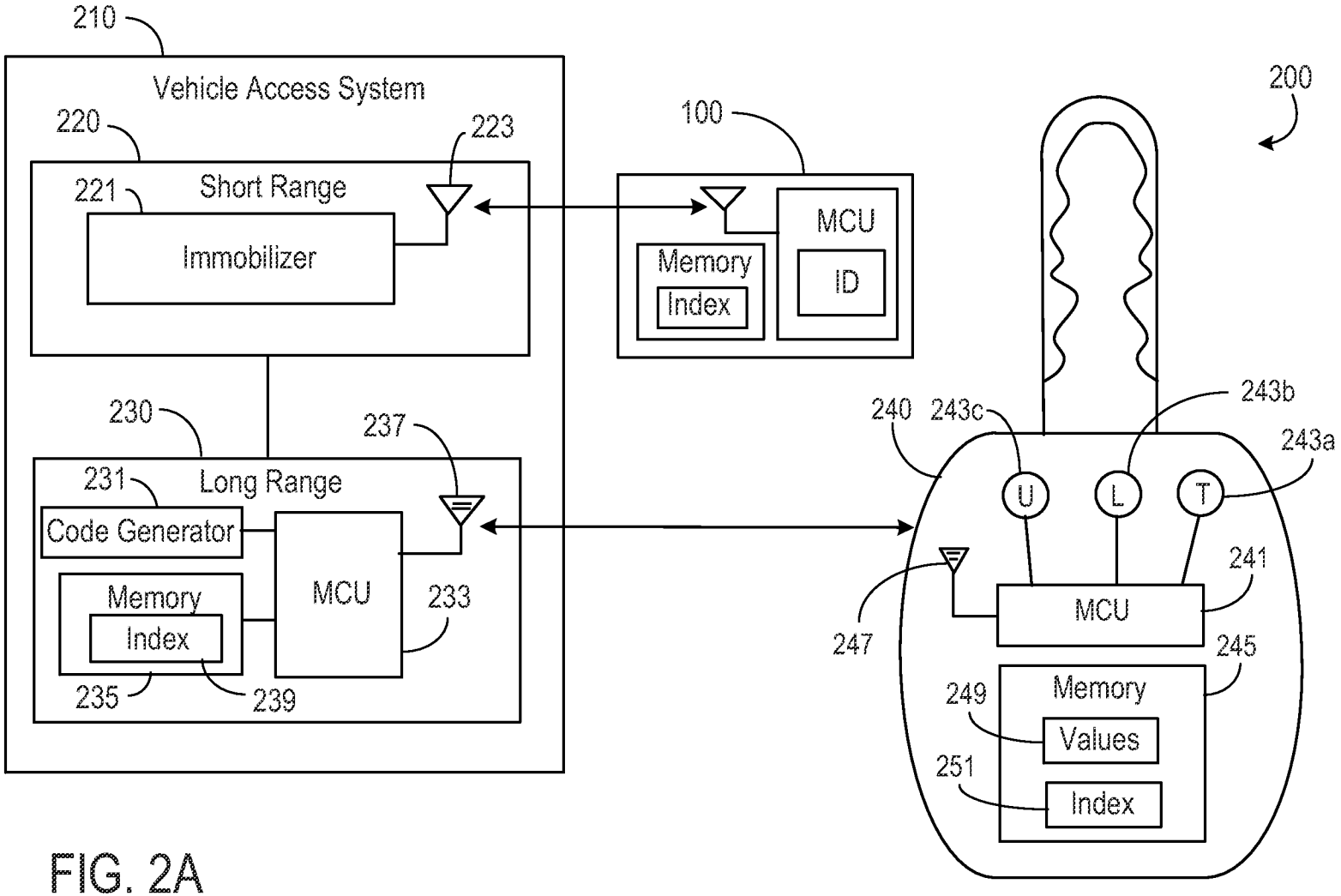
FIG. 2A shows an example operation of a vehicle access system with a short range communication device and longer range communication device.

FIG. 2A shows an example operation 200 of a vehicle access system 210 with a short range communication device 100 and longer range communication device 240. The longer range communication device 240 is a replacement remote access device for an end user to keep and later use with a vehicle access system 220. An end user will use the short range communication device to program the longer range communication device for use with the access system.

The vehicle access system features a short range communication system 220. As part of the short range communication system, an immobilizer uses short range antenna 223 to communicate with the short range communication device 100.

The vehicle access system also features a longer range communication system. A code generator 231 generates a code that it uses to verify signals received from a longer range communication device. In this example, the code generator 231 is a rolling code generator. Other examples use other types of code generators. A memory 235 stores an index counter 239 for the code generator. A controller such as an MCU 233 manages operation of the longer range communication system. A long range antenna 237 communicates over long ranges up to many meters using high frequencies, such as from 300-500 megahertz. Some communication uses frequencies from 315-434 megahertz. Some communication reaches 30 meters or more. Other forms of longer range communication, such as Wi-Fi or cellular signals, can reach even farther, e.g., using different frequencies.

A longer range communication device 240 communicates with the vehicle access system via long range antenna 247. The longer range communication device is a remote access device capable of operating the trunk 243*a*, lock 243*b*, and unlock 243*c* functions. Memory 245 stores a series of access values. Control logic such as an MCU 245 selects an access value from the stored access values based on a button that a user actuates. An index keeps track of the position of the access value in the series of access values.

In some examples, each access value in the series of access values corresponds to one function. Successive access values in the series of access values generally operate different functions. The microcontroller iterates through the series until an access value operates the desired function, and then the microcontroller uses the antenna to transmit that access value. In contrast, the rolling code generator 231 combines an algorithmically generated base code with a function code to generate multiple codes. The rolling code generator checks to see that an access code received via antenna 237 matches a valid, upcoming code and updates the index 239 to keep track of the rolling code position.

To program a vehicle access system, the MCU ID is communicated in order for the code generator to generate the proper codes. In some cases, the code generator uses the ID as a seed or a lookup reference value. This means that only a specific series of reference values will work with a system that has been programmed to recognize a certain MCU ID.

Figure 2B:
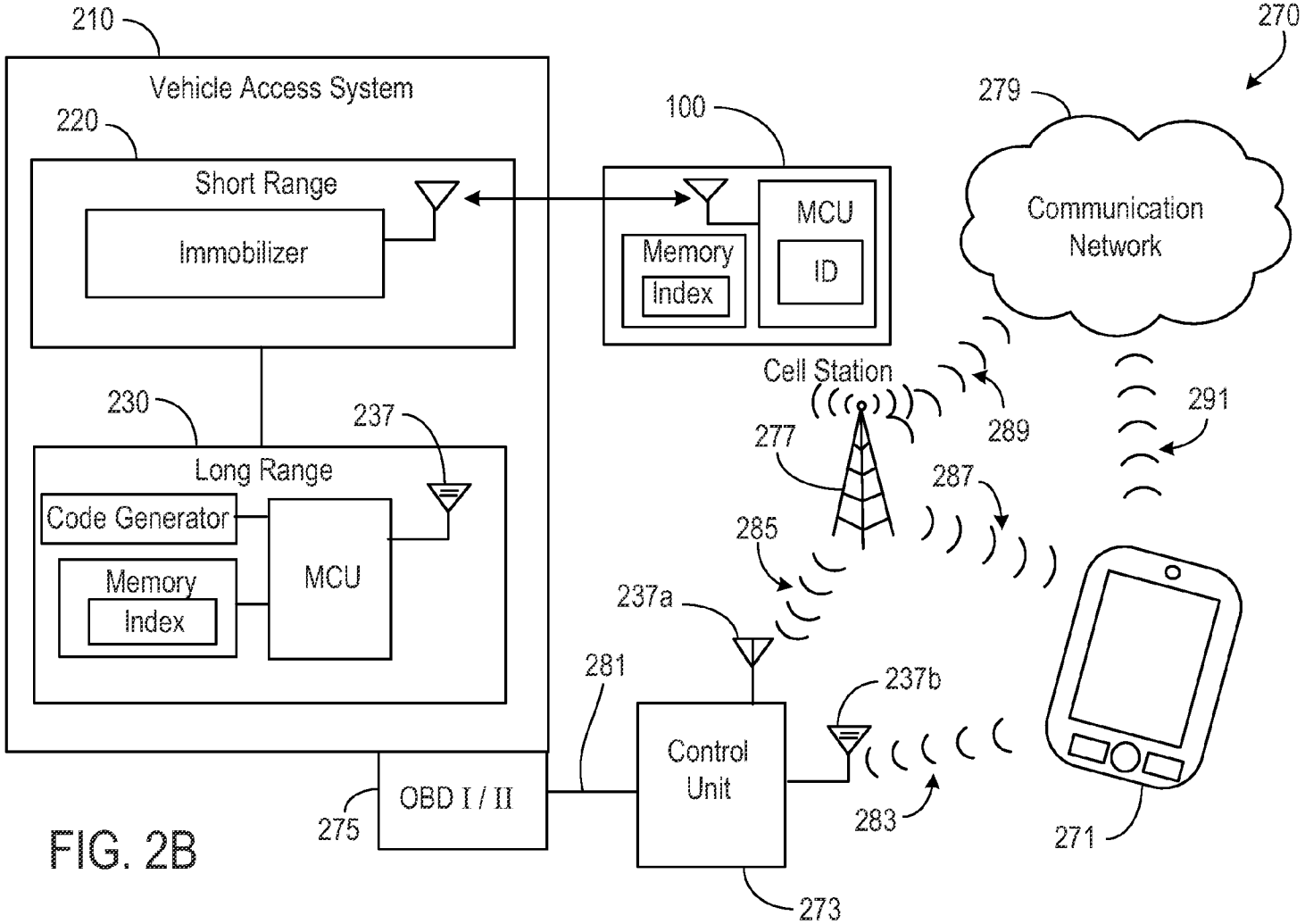
FIG. 2B shows an example indirect operation of a vehicle access system with a longer range communication device.

FIG. 2B shows an example indirect operation 270 of a vehicle access system with a longer range communication device. The short range communication device 100 programs vehicle access system 210 to subsequently allow a remote access device 271 to operate the vehicle access system using a specific series of access values.

A longer range communication device, such as a laptop, computer, cell phone, smartphone 271, tablet, etc. downloads the specific series of access values through a communication network 279 such as the internet. Downloading may occur through a wireless internet connection 291. The longer range communication device can transmit those access values through the longer range antenna 237 to operate the vehicle access system.

Alternatively, the longer range communication device can wirelessly transmit signals 283 to a control unit 273 physically coupled 281 to the access system, such as through an on-board diagnostic port 275. The control unit may communicate directly to the smartphone 271 using long range antenna 237*b*. Alternatively, the control unit may communicate indirectly to the smartphone through the cellular network using cellular long range antenna 237*a*.

From even farther distances, smartphone 287 can transmit wireless signals 287 through a cell station 277, which then transmits wireless signals 285 to the control unit 281. In some examples, the smartphone downloads the access values through the cell station connected 289 to the communication network. In some examples, the series of access values are not downloaded into the smartphone, but instead into the control unit. The control unit uses the access values to operate the vehicle access system upon receiving certain commands 283 from the smartphone 271.

Figure 3:
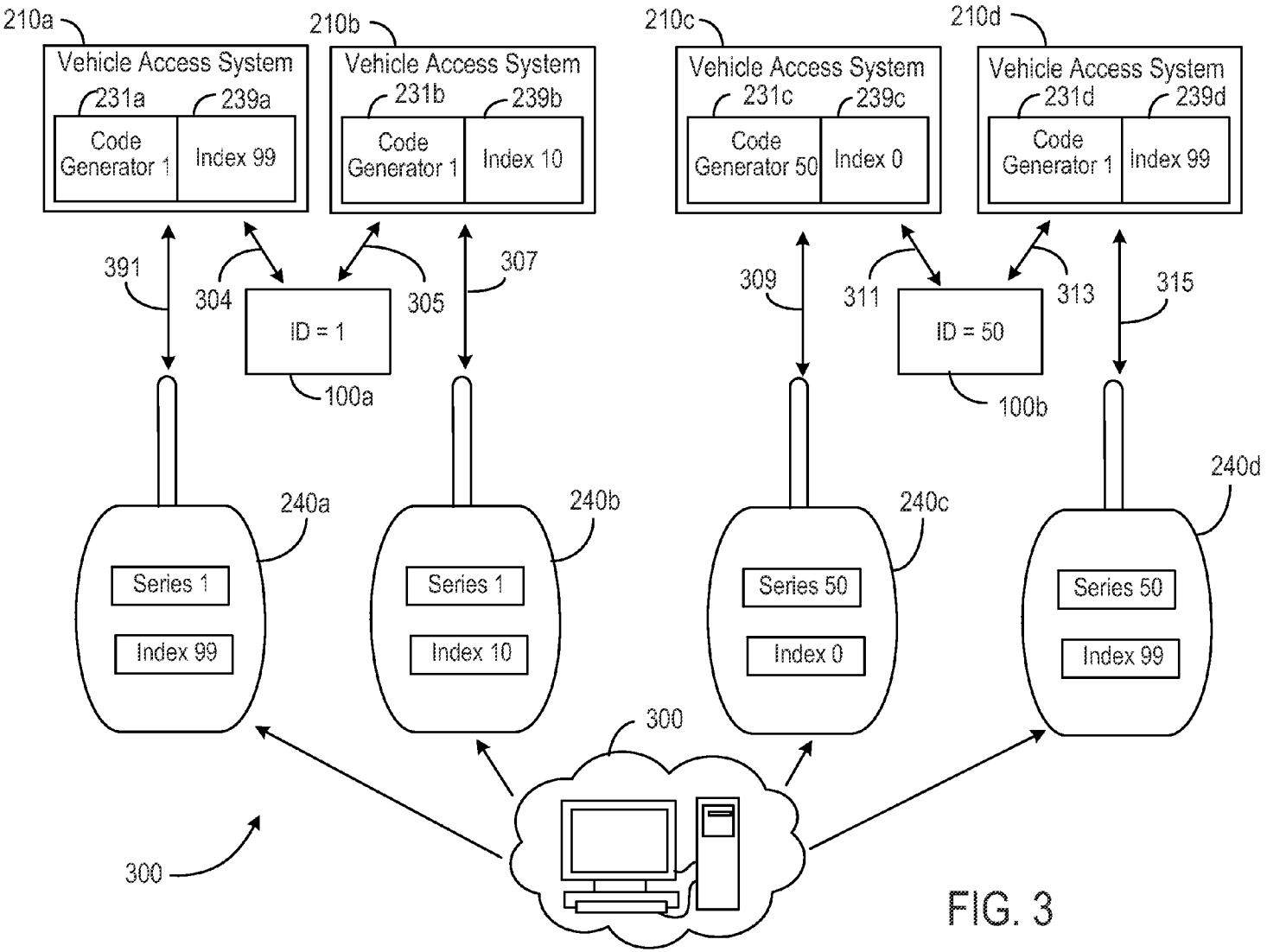
FIG. 3 shows an example system with a plurality of interactions between vehicle access systems, short range communication devices, and longer range communication devices.

FIG. 3 shows an example system 300 featuring a plurality of interactions between vehicle access systems 210[*a-d*] of different vehicles, short range communication devices 100 [*a-b*], and longer range communication devices [240*a-d*].

A service provider stores a series of access values, each series for use with a specific MCU ID, on a server connected to a remote communication system 320 such as the internet. When a first user receives short range communication device 100*a* and remote access device 240*a*, the first user can download onto remote access device 240*a* the series of access values that can access a vehicle access system paired with the MCU ID of the first user's short range communication device 100*a*.

To enable the first user to download the correct series of access values, each short range communication device may have a label that the first user can read. The label may or may not be the same as the MCU ID, but generally it will distinguish which short range communication devices have MCU's of certain ID's. For example, a user receiving short range communication device 100*a* having a label and MCU ID of 1 can use a computer, e.g., a personal computer, to connect to communication system 320. The first user can look up the correct series of access values to download onto the remote access device 240*a* an access series for use with an MCU ID of 1. The first user may also download an initial index for the series of access values.

The first user then takes steps to initialize a programming mode with access system 210*a* of the user's first vehicle. As part of programming, the user presents the short range communication device 100*a* by holding it close to the vehicle access system, typically near the key stalk of the steering wheel column, to use low frequency, short range communication to transmit the MCU ID=1 information to the access system. The access system then sets the code generator 231*a* to validate the access values from the matching series of access values. As the user operates the remote access device, the initial index will increment to track the progression of the access values used from the series of access values. At some point, the customer may have reached the $99^{th}$ access value from the series of access values.

The first user may program another access system 210*b* of a second vehicle in the same way by downloading, from communication system 420, the MCU ID and an initial access index (not shown), which are stored onto a second remote access device 240*b*. The initial access index may be the same access index used for the first vehicle, or it can be different access index. The first user can then initiate a programming mode with the second vehicle and use the short range communication device 100*a* to communicate the MCU ID of 1 via short range, low frequency communication. The short range communication device may also communicate the initial access index. The second access system 210*b* learns the new ID and access index. It programs the code generator 231*b* to work with matching series of access values and keeps track of the index value as the user operates functions. Through operating the remote access device 240*b*, the user may use up 10 values of the series, causing the index value in the remote access device 240*b* to store a value of 10 in its memory. The access system tracks the index as well when receiving signals from the second remote access system and also displays an index 239*b* of 10.

Although remote access devices 240*a* and 240*b* use the same series of access values, if the indexes are sufficiently different or if the access systems are sufficiently far apart from each other, then no interference should occur. In some situations, the access system registers identification codes of the longer range access devices in order to prevent any interference. Alternatively, the process can program a plurality of keys to work with one car. Sometimes, a single user will use different short range communication devices to program different vehicles. For example, a locksmith may keep a large number of short range access devices and use different short range access devices to program longer range access devices to work with the vehicle access systems of different customers.

A second user may obtain the second short range communication device 100*b* to program a third remote access device 240*c* with a third access system 210*c* of a third vehicle. The short range communication device has a different MCU ID value of 50. When the second user downloads the series of access values that corresponds to MCU ID of 50 onto the remote access device 240*c*, the downloaded codes will not interfere with the operation of either access systems 210*a* or 210*b*.

In addition, remote access device 240*c* can download a new index value. The new index value does not need to be different from the initial index value downloaded onto remote access device 240*a*, but either way interference will not occur between operating 240*c* and 240*a* because they use different series of access values. After the second user obtains possession of short range communication device 100*b*, the second user initiates a programming procedure to communicate 311 the MCU ID=50 and second index value to the vehicle access system 210*c*. The second user can then operate the remote access device 240*c* to operate access system 210*c*, and the indexes stored in 240*c* and 210*c* should track each other.

A service provider may instruct the second user to send the short range communication device 100*b* away, either directly or back through the service provider, to a last user. The last user has remote access device 240*d* and, upon receiving the short range communication device 100*b*, uses it to program the last access system 210*d* of a last vehicle. During the process, various examples may use a same or different index from the second index. The index counter in the access system 239*d* tracks the index in the remote access device 240*d*.

Figure 4:
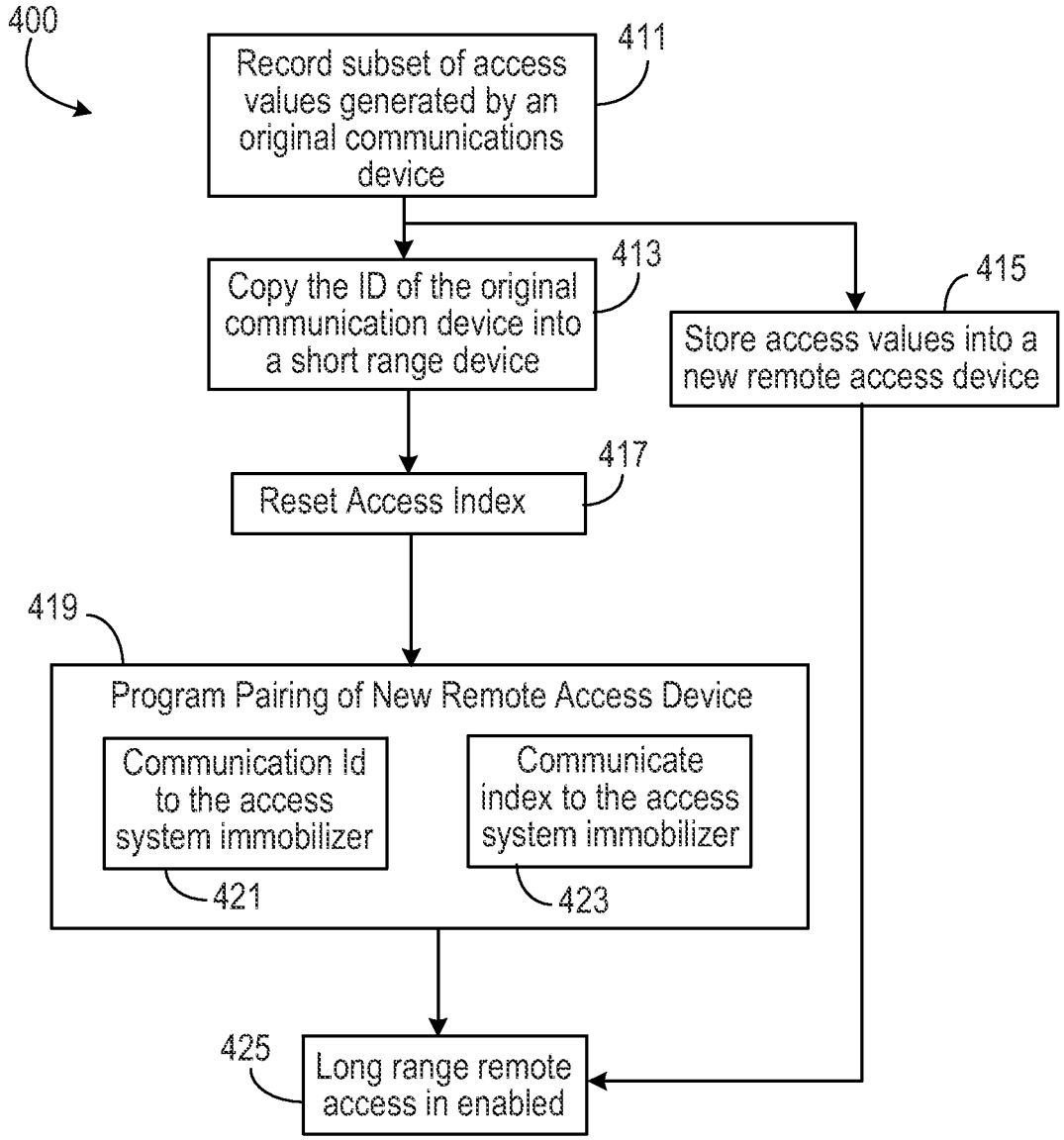
FIG. 4 shows a method for making a short range communication device for programming an access system.

FIG. 4 is a flow diagram of an example method 400 for making a short range communication device for programming an access system. An original communication device generates a subset of values. The original communication device can program access systems of certain types of vehicles without needing a short range communication device. The original communication devices contain a rolling code generator that outputs access values when the remote functions are actuated. Usually the original communication devices come from the vehicle's manufacturer instead of a $3^{rd}$ party replacement access device service provider.

A service provider obtains an original communication device and actuates functions 411 in a sequence and stores the resulting outputs as a series of access values onto a communication network. The service provider may reset 417 the access index after actuating the functions. Resetting the access index gives it an initial value that refers to an initial or early point in the series of access values. In some instances, the initial value can refer to a point before the generated series of access values, and in these instances, a user may need to synchronize a remote access device after programming it. At this point, the service provider may use a protective measure to prevent an end user from subsequently changing the value of the access index in the short range communication device.

The service provider then sends short range communication devices to vehicle owners who need to program vehicle access systems. In some examples, service provider may modify and send the original communication device as the short range communication device. In other examples, the service provider can make a substitute short range communication device having the same MCU ID as the original communication device and send the substitute short range communication device to the vehicle owners.

A vehicle owner who wants to program a remote access device (often a replacement remote access device) downloads the series of access values through the communication network into the remote access device. The short range communication device can then program 419 a vehicle access device for use with the remote access device. This may require that the short range communication device communicate the MCU ID through an immobilizer of the access system. As part of this process, the short range communication device may also communicate 423 the index value.

Completing the programming process enables 425 the vehicle owner to subsequently use the long range communication device to operate functions of the vehicle.

Figure 5:
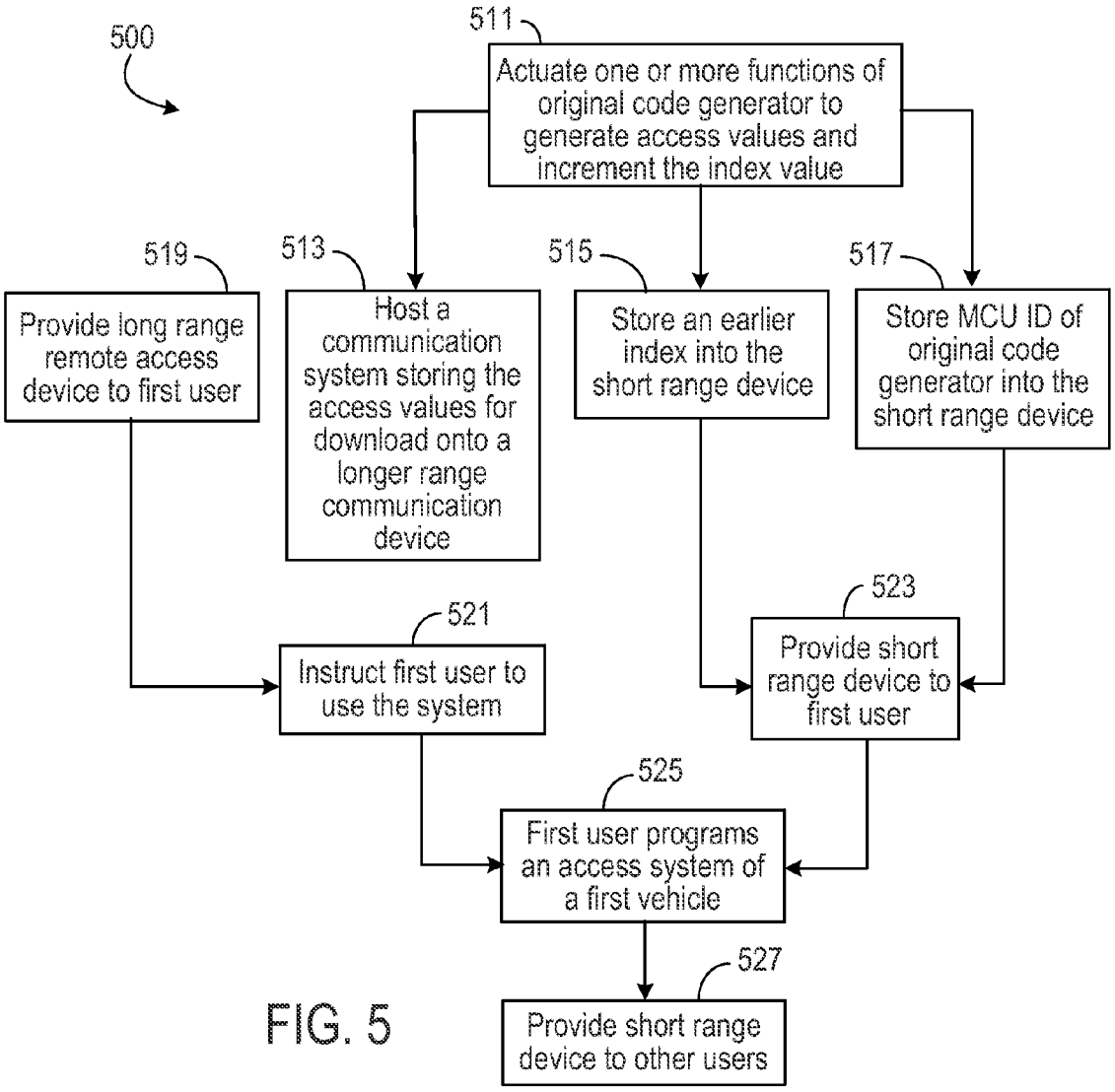
FIG. 5 shows a method performed by a service provider.

FIG. 5 is a flow diagram of an example method 500 performed by a service provider. The service provider actuates 511 one or more functions of an original code generator to generate a series access values, incrementing an index value each time. The service provider hosts 513 a communication system to store the series of access so that a user can download the series of access values onto a longer range communication device such as a remote access device. The service provider also stores 515 an earlier index value into a short range communication device and stores 517 the MCU ID of the original code generator into the short range communication device. The short range communication device can be the original code generator, in which case step 515 is not necessary because the ID is inherent.

The service provider then provides 523 the short range communication device to a first user and also provides 519 a longer range communication device to the first user. The service provider then instructs 521 the first user on how to use the short range communication device to program a vehicle access system to allow access from the longer range communication device. The first user can program 525 the vehicle access system. The service provider then provides the short range device to other users.

Figure 6:
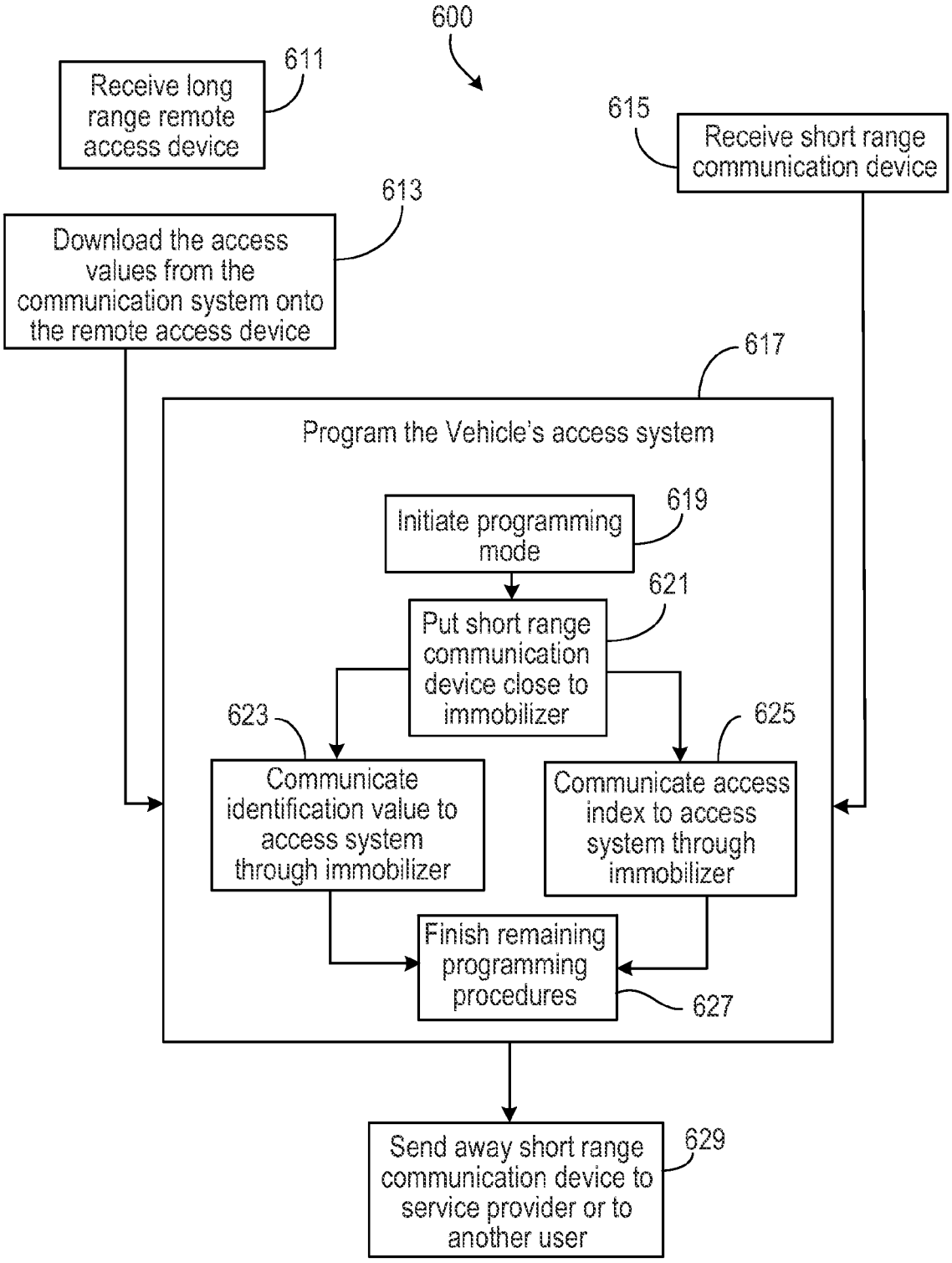
FIG. 6 shows an example instruction sequence provided to an end user.

FIG. 6 shows an example instruction sequence 600 provided to an end user, such as in step 521 of FIG. 5. The user receives both the longer range communication device 611 and the short range communication device 615. After receiving the longer range communication device, the user downloads a series of access values onto the longer range communication device. The series of access values contains access values that were output by an original generator having the MCU ID of the short range communication device. Then, the user programs 617 the vehicle access system. The service provider gives the user instructions on how to initiate 619 a programming mode for the user's type of vehicle. As part of the process, the user puts 621 the short range communication device close to the access system to establish short range communication. Often, the short range communication occurs between the short range communication device and an immobilizer of the access through a distance of millimeters or centimeters using low frequencies between 1 kilohertz to 100 megahertz. Some short range communication devices use frequencies at about 125 kilohertz. As part of the communication, the short range device communicates the MCU ID 623 and the access index 625 to the access system. The user then finishes 627 any remaining programming procedures, thereby enabling subsequent access to the vehicle using the remote access device. The user then sends away the communication device, either back to the service provider or to another user.

Like reference symbols in the various drawings indicate like elements.

A number of examples of the invention have been described. Nevertheless, it will be understood that various modifications may be made without departing from the spirit and scope of the invention. For example, the methods may be performed with variations to the steps and order of steps. The example in FIG. 3 can be performed by the same or different users on single or multiple access systems. Sometimes, the end user may synchronize the remote access device with an access system during or after programming in order to synchronize index values. Sometimes, a technician or salesman performs the programming steps instead of the end user. The longer range communication device can be a smartphone, tablet, laptop, etc. Although examples use the MCU ID as the property communicated from the short range communication device, other examples may communicate some other information besides ID as part of the code generating algorithm. The service providers, in the example, may change the access index for different users to prevent interference. Accordingly, other examples are within the scope of the following claims.

What is claimed is:

1. A method performed by a service provider and allowing a plurality of end users to program vehicle access systems and remote access devices, comprising:

actuating one or more functions of an original code generator, the original code generator comprising short range communication and longer range communication functions, to generate a series of access values referenced by an access index, each actuation causing the access index to change, the series of access values being a subset of a larger series of valid access values;

storing the series of access values in a communication system configured to, upon receiving unique label identifier as an input, permit downloading of the series of access values;

disabling one or more longer range communication functions of the original code generator;

labeling the original code generator with the unique label identifier;

setting an access index of the original code generator to reference a preceding access value;

providing one or more remote access devices to each end user of a plurality of end users, wherein each remote access device comprises short range communication and longer range communication functions;

sending the original generator device to a plurality of end users; and instructing each end user of the plurality of end users to program the end users remote access device and the end users vehicle access system of the end users vehicle, by:

downloading the series of access values from the communications system onto the end user's remote access device;

programming the end users vehicle access system to subsequently allow the end user's remote access device to use longer range communication to control one or more functions of the end users vehicle, wherein programming comprises:

initiating a programming mode of the end users vehicle;

presenting the original generator to an immobilizer of the end users vehicle access system; and communicating, via short range communication, an identification value and the access index from the original generator to the end users vehicle access system;

retaining the end users remote access device; and sending away the original generator.

2. A method for operating a dual range communication device that is configured for short and longer range communication functionalities with a vehicle, the longer range communication for authentication with vehicle access systems, comprising:

saving a series of access values generated by the dual range communication device, the series of access values being a subset of an entire set of valid access values for said vehicle access systems;

setting an access index into the dual range communication device, wherein the access index references a first access value that precedes other values from the series of access values;

disabling one or more longer range functionalities of the dual range communication device;

labeling the dual range communication device with a unique label to identify the series of access values originated from the dual range communication device;

sending the dual range communication device to a plurality of users to pair longer range communication devices of the users such that during a programming process for each longer range communication device, pairing by communicating through a short range antenna of the dual range communication device, an identification value to a certain vehicle access system of the access systems of vehicles of the users; and configuring the dual range communication device to communicate, during the programming process, the access index to the vehicle access systems using the short range antenna.

3. The method of claim 2, wherein communicating through the short range antenna comprises communicating to an immobilizer device of the vehicle access systems.

4. The method of claim 2, wherein communicating to a first vehicle access system of the plurality of vehicle access systems enables a first remote access device to subsequently remotely control functions of a vehicle when the first remote access device transmits, via a first longer range antenna, a first value from the series of access values to the first vehicle access system; and wherein communicating to a second vehicle access system of the plurality of vehicle access systems enables a second remote access device to operate with the second vehicle access system when the second remote access device transmits, via a second longer range antenna, the first value from the series of access values to the second vehicle access system.

5. The method of claim 2, wherein disabling one or more long range functionalities comprises at least one of:

opening a circuit;

shorting a circuit;

covering a button;

disabling a button; or programming code to preserve the access index.

6. A system for pairing remote access devices with access systems of vehicles, comprising:

a communication system for storing a certain sequence of access values;

a certain access system of a vehicle;

a plurality of remote access devices; and a dual range communication device comprising:

a microcontroller unit identified by a certain identification value;

a memory configured to store an access index referencing a first access value that precedes other values from the certain sequence of access values configured for said vehicle access systems;

a short range antenna;

a longer range antenna for operating longer range communication functionalities including authentication with vehicle access systems; and a unique label for identifying the certain sequence of access values originated from the short range communication device;

wherein the communication system is configured to download the certain sequence of access values to each of the plurality of remote access devices;

wherein the dual range communication device is configured to disable one or more longer range functionalities; and wherein the dual range communication device is configured to communicate, using the short range antenna, the access index to the certain access system to enable subsequent access to the certain access system by the certain remote access device of the plurality of remote access devices via a corresponding longer range antenna of the certain remote access device.

7. The system of claim 6, wherein the certain remote access device stores the certain sequence of access values in a memory, the certain sequence of access values being a subset of access values generated by the dual range communication device with the microcontroller unit associated with the certain identification value.

8. The system of claim 6, further comprising:

a plurality of dual range communication devices, each dual range communication device comprising:

a microcontroller unit associated with an identification value different from other microcontrollers of other dual range communication devices;

a memory configured to store an access index;

a short range antenna;

a longer range antenna; and a label different from labels of other short range communication devices: and a communication system configured to store a unique access sequence for each one of the plurality of short range communication devices with a different label.

9. The system of claim 8, wherein the communication system is configured to store an access number as the access index of the selected remote access device.

10. The system of claim 6, further comprising a control unit physically coupled to an access system through an on-board port;

wherein the remote access devices are at least one of:

a phone;

a tablet;

a laptop;

each remote access device is configured to download, from a communication system, an application to communicate with the control unit to operate the vehicle access system.

11. The system of claim 6, wherein the dual range communication device further comprises a protective design disabling the access index from changing, the protective design comprising at least one of:

opening a circuit;

shorting a circuit;

covering a button;

disabling a button; or programming code to preserve the index.

12. The system of claim 6, wherein the dual range communication device is configured to communicate, using the short range antenna, the certain identification value to an immobilizer of the certain access system.

13. A dual range communication device that is configured for short and longer range communication functionalities with a vehicle, the longer range communication for authentication with vehicle access systems, comprising:

a short range antenna configured for wireless communication;

a longer range antenna;

a memory configured to store a plurality of access values and an access index referencing a first access value that precedes other values from the plurality of access values;

a unique label for identifying the plurality of access values originated from the dual range communication device; and a microcontroller unit identifiable by an identification value;

wherein the dual range communication device is configured to:

disable one or more long range functionalities of the dual range communication device, communicate, using the short range antenna, the plurality of access values to a separate remote access device;

communicate, using the short range antenna, the device identification value with an immobilizer of a vehicle to enable access to the vehicle from the separate remote access device via a longer range antenna of the separate remote access device, and communicate, using the short range antenna, the access index to an access system of the vehicle.

14. The dual range communication device of claim 13, wherein the separate remote access device is configured to utilize the plurality of access values generated by the dual range communication device having the identification value, the access values being a subset of a larger set of valid access values for the access system of the vehicle.

15. The dual range communication device of claim 13, wherein the short range antenna is a near field antenna.

16. The dual range communication device of claim 13, wherein the short range antenna communicates using one or more frequencies approximately ranging from 1 kilohertz to 100 megahertz, each of the one or more frequencies being lower than any frequency used by the longer range antenna.

17. The dual range communication device of claim 13, wherein the longer range antenna communicates using other frequencies approximately ranging from 300 megahertz to 500 megahertz, the longer range antenna configured to operate over a range of at least 3 meters.

18. The dual range communication device of claim 13, wherein the memory is configured to store an index counter, and wherein the index counter is configured to be reset before the dual range communication device communicates with an immobilizer.

19. The dual range communication device of claim 18, further comprising a protective design to prevent the index counter from changing.

* * * * *